US007043842B1

(12) United States Patent
Taylor et al.

(10) Patent No.: US 7,043,842 B1
(45) Date of Patent: May 16, 2006

(54) AUTOMATIC RINSING RAZOR SYSTEM

(76) Inventors: William Taylor, 4 Winding Hills Rd., Wallkill, NY (US) 12589; Pota Taylor, 4 Winding Hills Rd., Wallkill, NY (US) 12589

( * ) Notice: Subject to any disclaimer, the term of this patent is extended or adjusted under 35 U.S.C. 154(b) by 101 days.

(21) Appl. No.: 10/793,377

(22) Filed: Mar. 1, 2004

Related U.S. Application Data

(60) Provisional application No. 60/458,136, filed on Mar. 27, 2003.

(51) Int. Cl.
*B26B 19/48* (2006.01)

(52) U.S. Cl. ..... 30/41.5

(58) Field of Classification Search ..... 30/41.5
See application file for complete search history.

(56) References Cited

U.S. PATENT DOCUMENTS 3,775,845 A * 12/1973 Kuhnl ..... 30/41
4,177,556 A 12/1979 Galli, Jr.
4,205,441 A * 6/1980 Turner ..... 30/41.5
4,228,586 A 10/1980 Thierry
4,480,387 A * 11/1984 d'Alayer de Costemore d'Arc ..... 30/41
4,733,468 A 3/1988 Zadro
5,058,271 A * 10/1991 Jursich et al. ..... 30/123
5,265,337 A * 11/1993 Lowder ..... 30/41.5
5,402,574 A * 4/1995 Milner ..... 30/41.5
5,600,887 A * 2/1997 Olson ..... 30/41.5
6,499,218 B1 * 12/2002 Rocha ..... 30/41

* cited by examiner

*Primary Examiner*—Charles Goodman

(57) ABSTRACT

A automatic rinsing razor system for cleaning hair and debris from a razor while shaving. The automatic rinsing razor system includes a body member comprising a handle portion and a head portion. The handle portion is designed for being gripped in a hand of a user. The head portion is coupled to the handle portion and is designed for being drawn along a skin of the user. At least one blade member is selectively coupled to the head portion whereby the blade member is designed for cutting hair at the level of the skin. A conduit member is coupled to the body member whereby the conduit member is in fluid communication with the head portion of the body member for permitting water to flow from the water source through the head portion of the body member to clean the blade member and the head portion.

11 Claims, 3 Drawing Sheets

AUTOMATIC RINSING RAZOR SYSTEM

This application claims the benefit of provisional application 60/458,136 filed Mar. 27, 2003.

BACKGROUND OF THE INVENTION

1. Field of the Invention

The present invention relates to razor systems and more particularly pertains to a new automatic rinsing razor system for cleaning hair and debris from a razor while shaving.

2. Description of the Prior Art

The use of razor systems is known in the prior art. U.S. Pat. No. 4,228,586 describes a device for allowing water to be transferred through a razor to clean debris from the blades of the razor. Another type of razor system is U.S. Pat. No. 4,177,556 having a shaving system that has a razor that is coupled to water source the direct water to the razor and sprays water on the blade of the razor to rinse the razor clean. U.S. Pat. No. 4,177,556 has a safety razor that includes a passageway to allow water to be dispensed across the blade to clean the blade.

While these devices fulfill their respective, particular objectives and requirements, the need remains for a system that has certain improved features that allow the system to dispense shaving lotion.

SUMMARY OF THE INVENTION

The present invention meets the needs presented above by providing a dispensing member containing the shaving lotion that is coupled to the conduit member to allow the shaving lotion to be dispensed onto the face of the user through the head portion of the body member.

Still yet another object of the present invention is to provide a new automatic rinsing razor system that provides a valve member between the body member and the conduit member to allow the user to control the flow of the fluid through the body member.

To this end, the present invention generally comprises a body member comprising a handle portion and a head portion. The handle portion is designed for being gripped in a hand of a user. The head portion is coupled to the handle portion and is designed for being drawn along a skin of the user. At least one blade member is selectively coupled to the head portion whereby the blade member is designed for cutting hair at the level of the skin. A conduit member is coupled to the body member whereby the conduit member is in fluid communication with the head portion of the body member for permitting water to flow from the water source through the head portion of the body member to clean the blade member and the head portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
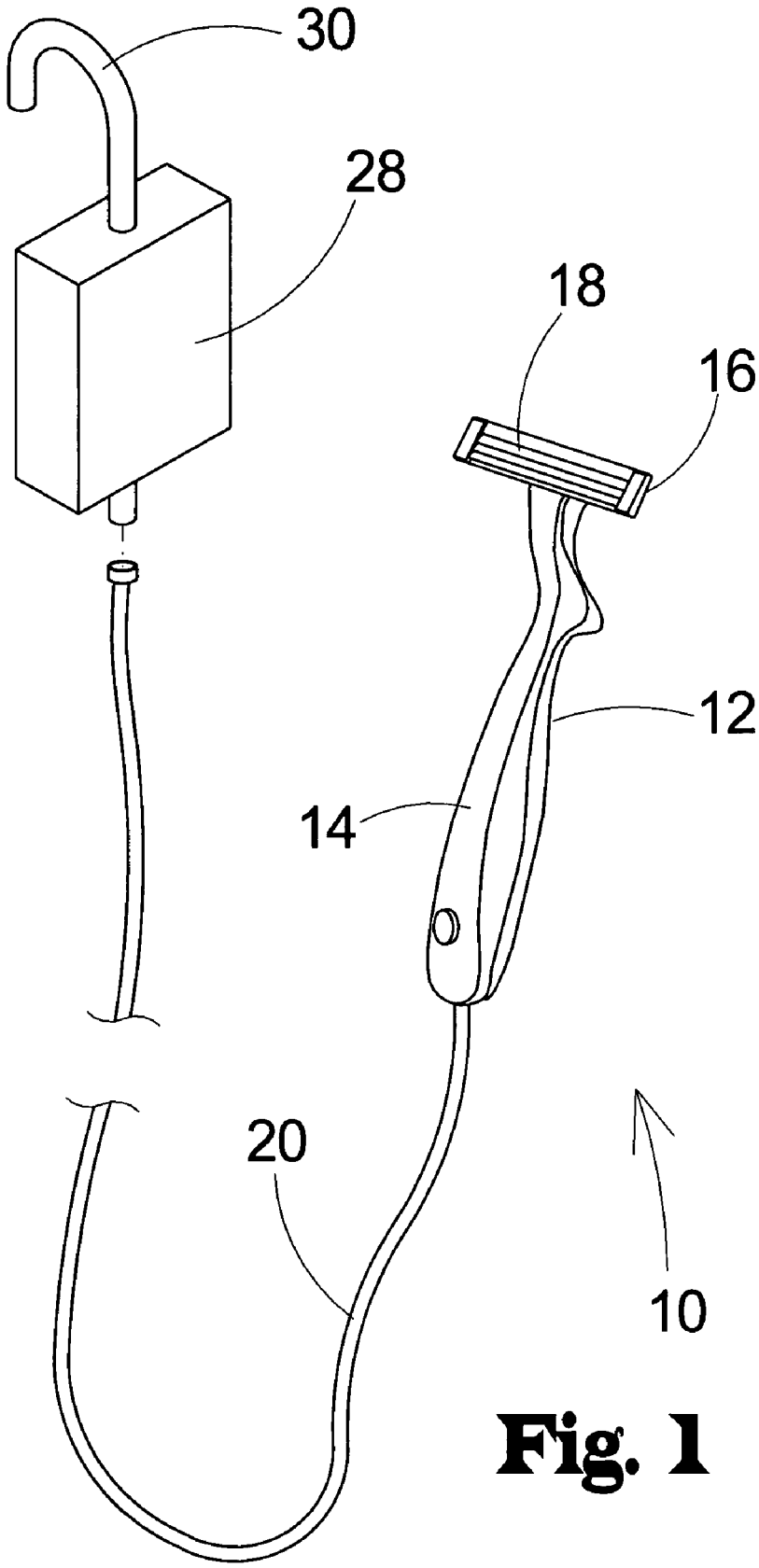
FIG. 1 is a perspective view of a new automatic rinsing razor system according to the present invention.
Figure 2:
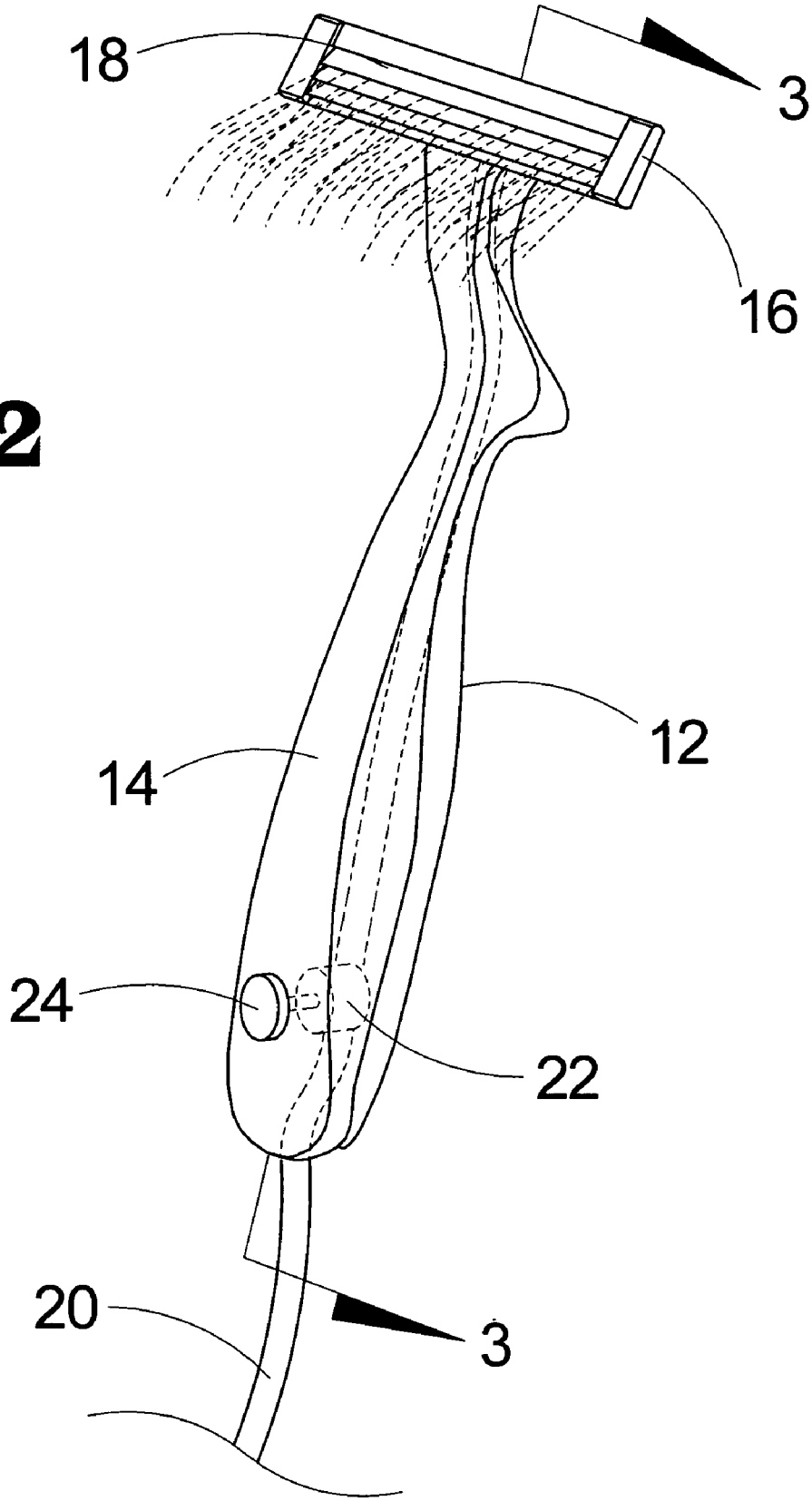
FIG. 2 is an enlarged perspective view of the present invention.
Figure 3:
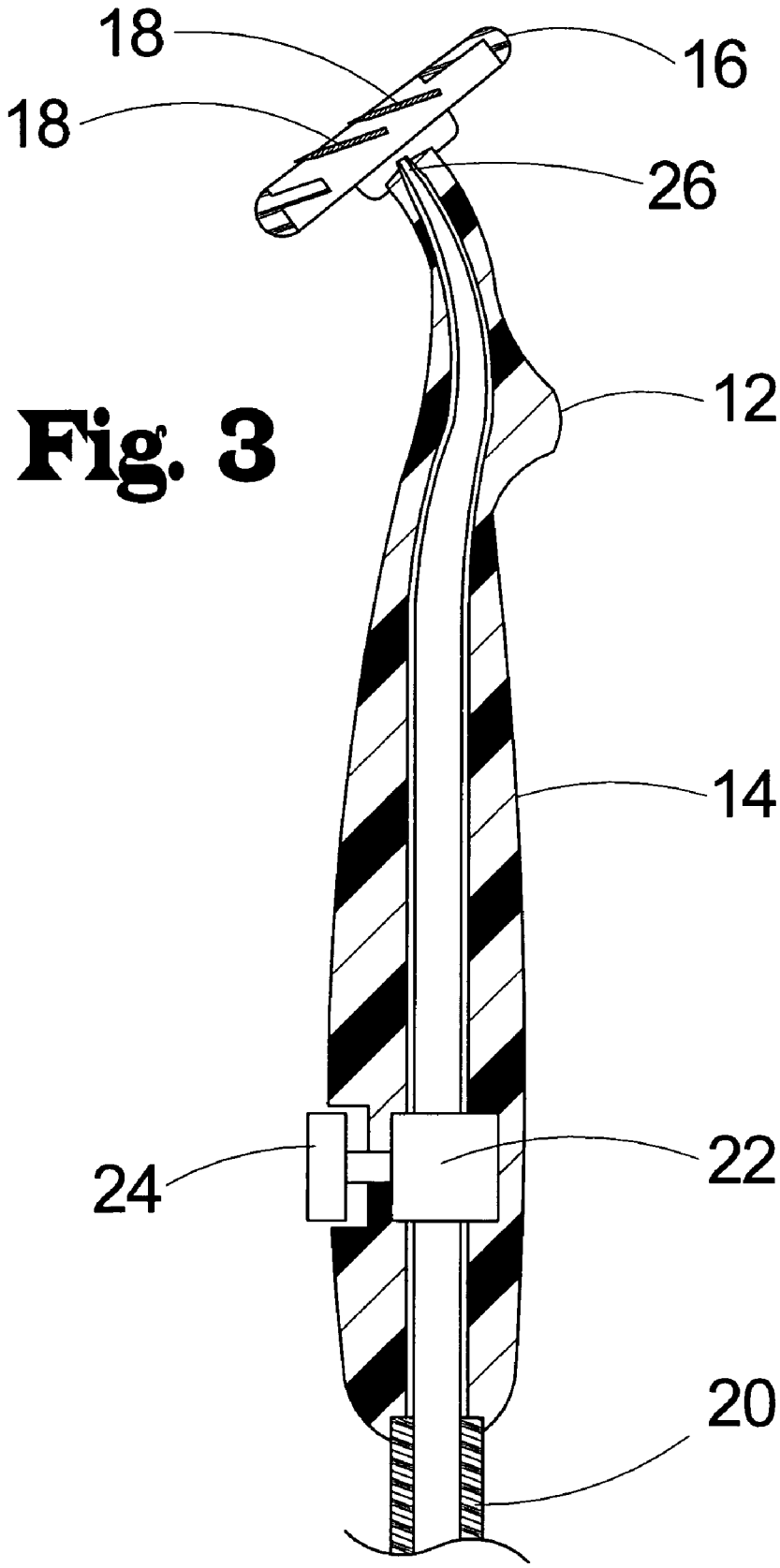
FIG. 3 is a cross-sectional view of the present invention taken along line 3—3 of FIG. 2.

With reference now to the drawings, and in particular to FIGS. 1 through 3 thereof, a new automatic rinsing razor system embodying the principles and concepts of the present invention and generally designated by the reference numeral 10 will be described.

As best illustrated in FIGS. 1 through 3, the automatic rinsing razor system 10 generally comprises a body member 12 comprising a handle portion 14 and a head portion. The handle portion 14 is designed for being gripped in a hand of a user. The head portion is coupled to the handle portion 14 whereby the head portion is designed for being drawn along a skin of the user.

At least one blade member 18 is selectively coupled to the head portion whereby the blade member 18 is designed for cutting hair at the level of the skin when the head portion is drawn along the skin of the user.

A conduit member 20 is coupled to the body member 12 whereby the conduit member 20 is in fluid communication with the head portion of the body member 12. The conduit member 20 is designed for being selectively coupled to a water source, such as a faucet or shower head, whereby the conduit member 20 is designed for permitting water to flow from the water source through the head portion of the body member 12 to allow the water to clean hair and debris from the blade member 18 and the head portion.

A valve member 22 being operationally coupled between the conduit member 20 and the body member 12. The valve member 22 is designed for controlling the flow of water from the conduit member 20 to the head portion of the body member 12 to control the pressure of water exiting the head portion.

The valve member 22 comprising a knob member 24. The knob member 24 actuates the valve member 22 to adjust the flow of water from the conduit member 20 to the head portion of the body member 12 when the knob member 24 is actuated by the user.

The body member 12 comprises a nozzle portion 26. The nozzle portion 26 is positioned in the head portion of the body member 12. The nozzle portion 26 is in fluid communication with the conduit member 20 whereby the nozzle portion 26 is designed for spraying water though the head portion and along the blade member 18 to rinse hair and debris from the head portion of the body member 12.

A dispensing member 28 may be operationally coupled to the conduit member 20. The dispenser member is designed for storing a shaving solution whereby the shaving solution is introduced into the conduit member 20 and through the head portion of body member 12 to apply the shaving solution to the skin of the user when the head portion is being drawn along the skin of the user.

A suspension member 30 is coupled to the dispenser member. The suspension member 30 is designed for engaging a support structure whereby the suspension member 30 is for suspending the dispensing member 28 from the support structure when the dispensing member 28 is coupled to the conduit member 20.

In use, the user places the blade member 18 into the head portion of the body member 12. The conduit member 20 is then coupled to the water source and the water source actuated to deliver water to the conduit member 20. The knob member 24 is adjusted by the user to adjust the pressure of the water exiting the nozzle portion 26 of the body member 12 to clean the hair and debris from the head portion. Alternately, the dispensing member 28 may is coupled to the conduit member 20 to dispensed the shaving solution onto the skin of the user to lubricated the head portion and the blade member 18 as the head portion is drawn along the skin of the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A automatic rinsing razor system for facilitating shaving, the automatic rinsing razor system comprising:

a body member comprising a handle portion and a head portion, said handle portion being adapted for being gripped in a hand of a user, said head portion being coupled to said handle portion such that said head portion being adapted for being drawn along a skin of the user, said handle portion having a front side and a back side said handle portion having a head end on which said bead portion is mounted and a tail end opposite of said head end, said head portion having a front side and a back side the back side of said head portion being oriented toward said handle portion;

at least one blade member being selectively coupled to said head portion such that said blade member is adapted for cutting hair at the level of the skin when said head portion is drawn along the skin of the user; and a conduit member being coupled to said body member such that said conduit member is in fluid communication with said head portion of said body member, said conduit member being adapted for being selectively coupled to a fluid source such that said conduit member is for permitting the fluid to flow from the fluid source through said head portion of said body member to allow the fluid to clean hair and debris from said blade member and said head portion;

said body member comprising a nozzle portion in fluid communication with said conduit member such that said nozzle portion is adapted for spraying fluid though said head portion and along said blade member to rinse hair and debris from said head portion of said body member, said nozzle portion being positioned on the head end of said handle portion and being oriented to spray fluid from said conduit toward and onto the back side of said head portion of said body member.

2. The automatic rinsing razor system as set forth in claim 1, further comprising:

a valve member being operationally coupled between said conduit member and said body member, said valve member being adapted for controlling the flow of fluid from said conduit member to said head portion of said body member to control said pressure of water exiting said head portion.

3. The automatic rinsing razor system as set forth in claim 2, further comprising:

said valve member comprising a knob member, said knob member actuates said valve member to adjust the flow of fluid from said conduit member to said head portion of said body member when said knob member is actuated by the user.

4. The automatic rinsing razor system as set forth in claim 3 wherein a recess is formed in said front side of said handle portion, said recess being located toward said tail end of said handle portion, said knob member being located in said recess in said front side of said handle portion, said knob member being at least partially inserted into said recess.

5. The automatic rinsing razor system as set forth in claim 1, further comprising:

a dispensing member being operationally coupled to said conduit member, said dispenser member being adapted for storing a shaving solution such that said shaving is introduced into said conduit member and through said head portion of body member to apply the shaving solution to the skin of the user when said head portion is being drawn along the skin of the user.

6. The automatic rinsing razor system as set forth in claim 5, further comprising:

a suspension member being coupled to said dispenser member, said suspension member being adapted for engaging a support structure such that said suspension member is for suspending said dispensing member from the support structure when said dispensing member is coupled to said conduit member.

7. The automatic rinsing razor system as set forth in claim 1 wherein the nozzle portion of said body member is oriented such that fluid leaving said nozzle portion in a stream travels substantially perpendicular to a face of said at least one blade member.

8. A automatic rinsing razor system for facilitating shaving, the automatic rinsing razor system comprising:

a body member comprising a handle portion and a head portion, said handle portion being adapted for being gripped in a hand of a user, said head portion being coupled to said handle portion such that said head portion being adapted for being drawn along a skin of the user, said handle portion having a front side and a back side, said handle portion having a head end on which said head portion is mounted and a tail end opposite of said head end, said head portion being positioned primarily on said front side of said handle portion such that said front side is oriented toward the face of the user when in use, a recess being formed in said front side of said handle portion, said recess being located toward said tail end of said handle portion, said head portion having a front side and a back side, the back side of said head portion being oriented toward said handle portion;

at least one blade member being selectively coupled to said head portion such that said blade member is adapted for cutting hair at the level of the skin when said head portion is drawn along the skin of the user;

a conduit member being coupled to said body member such that said conduit member is in fluid communication with said head portion of said body member, said conduit member being adapted for being selectively coupled to a fluid source such that said conduit member is for permitting the fluid to flow from the fluid source through said head portion of said body member to allow the fluid to clean hair and debris from said blade member and said head portion;

a valve member being operationally coupled between said conduit member and said body member, said valve member being adapted for controlling the flow of fluid from said conduit member to said head portion of said body member to control said pressure of water exiting said head portion;

said valve member comprising a knob member, said knob member actuates said valve member to adjust the flow of fluid from said conduit member to said head portion of said body member when said knob member is actuated by the user, said knob member being located in said recess in said front side of said handle portion, said knob member being at least partially inserted into said recess; and said body member comprising a nozzle portion, said nozzle portion being in fluid communication with said conduit member such that said nozzle portion is adapted for spraying fluid though said head portion and along said blade member to rinse hair and debris from said head portion of said body member, said nozzle portion being positioned on the head end of said handle portion and being oriented to spray fluid from said conduit toward the back side of said head portion of said body member.

9. The automatic rinsing razor system as set forth in claim 8, further comprising:

a dispensing member being operationally coupled to said conduit member, said dispenser member being adapted for storing a shaving solution such that said shaving is introduced into said conduit member and through said head portion of body member to apply the shaving solution to the skin of the user when said head portion is being drawn along the skin of the user.

10. The automatic rinsing razor system as set forth in claim 9, further comprising:

a suspension member being coupled to said dispenser member, said suspension member being adapted for engaging a support structure such that said suspension member is for suspending said dispensing member from the support structure when said dispensing member is coupled to said conduit member.

11. The automatic rinsing razor system as set forth in claim 10 wherein the nozzle portion of said body member is oriented such that fluid leaving said nozzle portion in a stream travels substantially perpendicular to a face of said at least one blade member.

* * * * *